United States Patent [19]

Stigter

[11] Patent Number: 4,505,215

[45] Date of Patent: Mar. 19, 1985

[54] SPLIT HOPPER VESSEL

[75] Inventor: Jan Stigter, Lekkerkerk, Netherlands

[73] Assignee: IHC Holland N.V., Papendrecht, Netherlands

[21] Appl. No.: 482,292

[22] Filed: Apr. 5, 1983

[30] Foreign Application Priority Data

Apr. 5, 1982 [NL] Netherlands ..... 8201436

[51] Int. Cl.[3] ..... B63B 35/30

[52] U.S. Cl. ..... 114/29

[58] Field of Search ..... 114/27, 28, 29, 30; 298/22 C, 22 P; 92/146, 73; 91/508, 437

[56] References Cited

U.S. PATENT DOCUMENTS

| | | | |
|---|---|---|---|
| 884,096 | 4/1908 | Leach | 91/508 |
| 1,274,345 | 7/1918 | Sterling | 91/437 X |
| 2,953,410 | 9/1960 | Chaney | 298/22 P |
| 3,036,555 | 5/1962 | Verderber | 121/38 |
| 3,101,974 | 8/1963 | Robertson et al. | 298/22 P |
| 4,143,584 | 3/1979 | Reneau | 91/172 |

FOREIGN PATENT DOCUMENTS

| | | |
|---|---|---|
| 6801242 | 7/1968 | Netherlands . |
| 516090 | 1/1972 | Switzerland . |

OTHER PUBLICATIONS

"Machinery & Production Engineering", Sep. 7, 1966; by H. C. Town, Some Hydraulic and Pneumatic Cylinder Arrangements for Machine Applications, pp. 508–515.

"Holland Shipbuilding", Mar. 1981, Krankebon, pp. 34–35.

*Primary Examiner*—Sherman D. Basinger

*Attorney, Agent, or Firm*—Young & Thompson

[57] ABSTRACT

Split hopper vessel comprising two half hulls which are pivotably connected to each other by a pivot shaft which extends at a high level parallel to the longitudinal axis of the ship. Both half hulls are furthermore connected to each other by means of cylinder pairs installed at an interval at a distance below the pivot shaft in a directiontransverse to the pivot shaft. The housings and the piston rods of each pair of cylinders are by cylindrical bearings connected to a respective axle, in common for both housings and for both piston rods, which axles themselves are, centrally between the housing bearings and the piston rod bearings connected to the respective part of the ship by a self adjusting bearing. The fluid lines between the rod sides on the one hand and the piston sides on the other hand of each pair of cylinders are embodied as rigid conduits, which are connected to both sides of one single remotely controllable locking- and safety valve for each pair of cylinders.

3 Claims, 7 Drawing Figures

SPLIT HOPPER VESSEL

The invention relates to a split hopper vessel comprising two half hulls which are pivotably connected through a pivot shaft situated at a high level parallel to the longitudinal axis of the ship, which both half hulls are mutually connected by means of cylinder combinations installed at intervals, especially near the bow and the stern of the ship at a distance below the pivot shaft and directed transversely to said pivot shaft, each of which cylinder combinations is with the cylinder body pivotably connected to said one half hull of the ship and with the piston rod to the other half hull of the ship, of which cylinder combinations the chambers on the rod side and the piston side are interconnected through a conduit in which a remotely controlled locking head is installed, which also functions as a safety valve.

Such a split hopper vessel is known, for instance the ship "De Krankeloon" described in "Holland Shipbuilding" March 1981, pages 34 and 35. Near the bow and near the stern of this ship two cylinder combinations are installed instead of the single cylinders which have been used in the past. However, because of the increasing volume of split hopper vessels said cylinders became unmanageably large and heavy and relatively expensive, whereas significantly large volumes of fluid have to be displaced in a short time, both during opening as well as closing of the ship. As compensation for this disadvantage the above mentioned "Krankeloon" is provided with two cylinders instead of each single cylinder, which two cylinders are each at both sides connected to the half hulls of the ship through adjustable hinges, especially ball type bearings.

In relation to the loading of the ship there has long been the problem that under the influence of the load both half hulls of the ship tend to bend in the transverse direction. The result thereof is a difference in the load of both cylinders in each pair of cylinders in such a sense that the cylinder which is positioned closer to the center of the ship is loaded in the expanding sense whereas the cylinder which is closer to the bow or stern of the ship is loaded in a compressing sense. That can lead to such an overload of the inside cylinder, that the safety valve between the rod side and the piston side will overflow resulting into a higher load on the cylinders, which ultimately creates a gap between both ship's halves through which load will be lost.

Because of safety reasons the classification authorities have not allowed the use of flexible tube connections in the hydraulic system of these mutually movable cylinders, because in case of a burst in said tube connection the split hopper vessel would open suddenly and therefor it is necessary to install a remotely controllable locking head and safety valve for each cylinder. Hydraulically equalizing the pressures in all these cylinders is therefor not possible.

An object of the invention is now to provide a construction which is more simple and effective when for opening and closing the half hulls of the ship a number of cylinders is used instead of only one cylinder, for instance two cylinders near the bow of the ship and two cylinders near the stern of the ship, such as for instance in the "Krankeloon".

Said object is according to the invention fulfilled in that in each pair of cylinders the housings and the pivot shafts are by means of cylindrical bearings connected to a respective axle, common to both houses and to both piston rods, which axles themselves are centrally between the housing bearings and the piston rod bearings mounted on a respective part of the ship by means of a self adjusting bearing whereby the connections between the rod sides on the one hand and the piston sides on the other hand of each pair of cylinders are embodied as rigid conduits, which are connected to both sides of one single remotely controllable locking head and safety valve for each pair of cylinders.

According to the invention the housings and the piston rods of the cylinders of each pair of cylinders are supported by a common axle such that only pivot movements around the center axis of this axle are possible. However, the axles themselves are connected to the respective ship's half in a self adjusting way by means of a self adjusting bearing, so that in case the ship's half hulls bend outwards an adjusting thereof in relation to said axles is possible without influencing the cylinders of each pair separately.

It is now possible to use rigid conduits for the connections on the rod sides and piston sides of all cylinders, which conduits are connected to both sides of the locking head and safety valve and it is possible to incorporate said conduits together with the cylinders into one single housing which comprises also the one single locking head and safety valve for each pair of cylinders.

The invention will now be explained in more detail with reference to the drawings.

Figure 3:
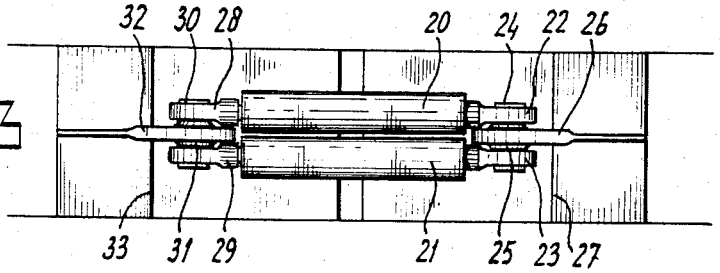
(PRIOR ART) Fig-3
FIG. 3 is a plan view of one pair of cylinders according to the invention.
Figure 3A:
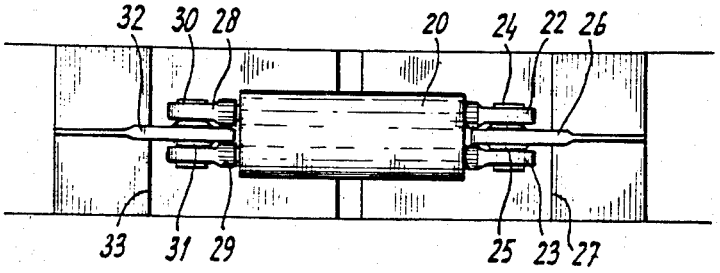

FIG. 3*a* shows a modification of the structure shown in FIG. 3.

Figure 4:
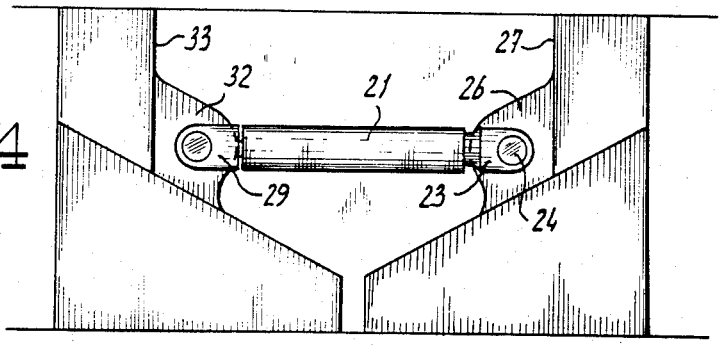

FIG. 4 shows a front view of one of the cylinders of FIG. 3.

Figure 5A:
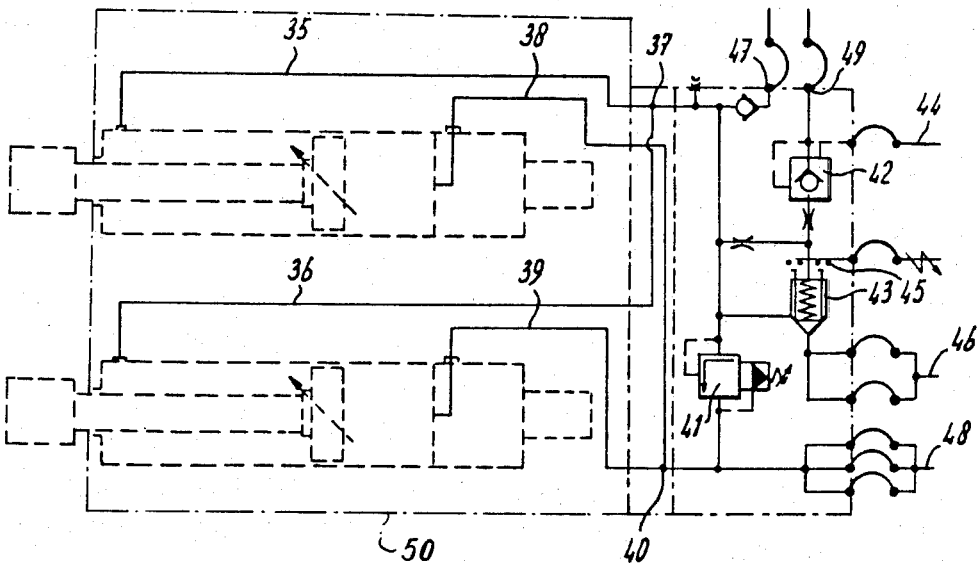
Figure 5:
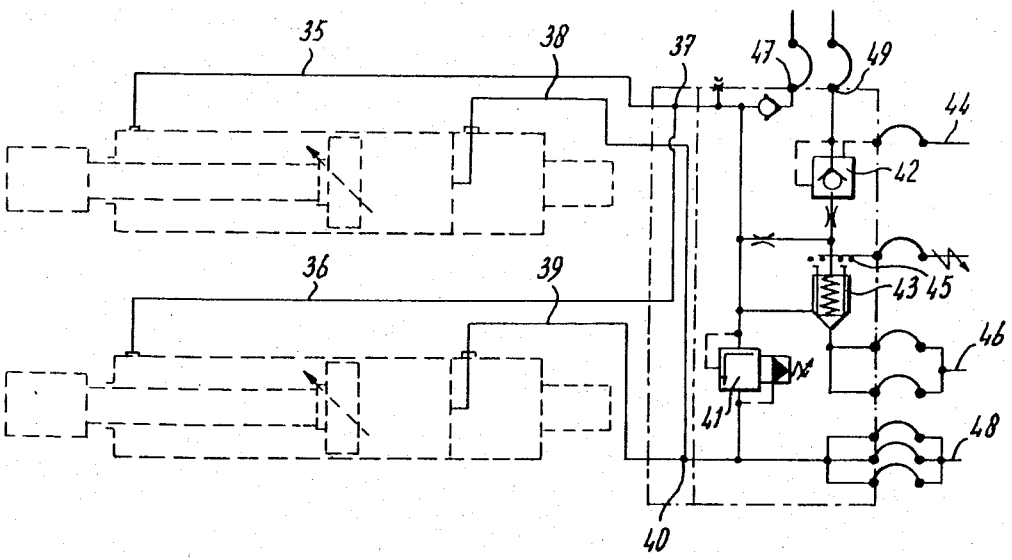

FIG. 5 is an hydraulic diagram of the pair of cylinders according to the invention.

FIG. 5*a* shows a modification of FIG. 5.

Figure 1:
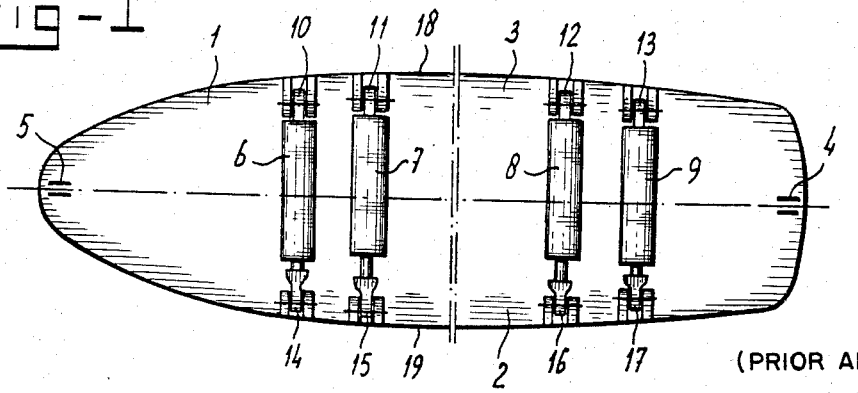
FIG. 1 illustrates schematically the configuration used in the known split hopper vessel the "Krankeloon".

FIG. 1 illustrates schematically a split hopper vessel 1 comprising a port side half 2 and a starboad side half 3, which are pivotably connected through horizontal pivot shafts, which are schematically indicated by 4 and 5 and which extend in the longitudinal direction.

Figure 2:
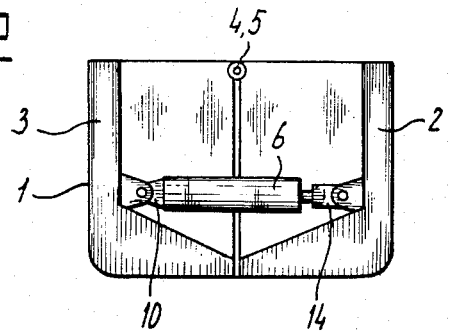
(PRIOR ART) Fig-2
FIG. 2 illustrates schematically a transverse cross section of the vessel illustrated in FIG. 1.

FIG. 2 illustrates schematically the positioning of the two half hulls 2 and 3 in mutual relation and in relation to the pivot parts 4 and 5.

The two cylinders 6 and 7 are installed near the bow end whereas the two cylinders 8 and 9 are installed near the stern end.

The housings of the cylinders 6, 7, 8 and 9 are connected to the inner wall of each ship's half hull by means of bearings 10, 11, 12 and 13 whereas the piston rods are in a similar way connected to the other ship's half hull through the bearings 14, 15, 16 and 17. By means of the convex lines 18 and 19 is indicated how both ship's half hulls bend outwards when the ship is loaded. The cylinder 7 is then forced to have a greater length than the cylinder 6 and the cylinder 8 is forced to have a greater length than the cylinder 9.

FIG. 3 illustrates the construction according to the invention comprising the cylinders 20 and 21 which together form the bow end or stern end cylinder pair. The housings are by means of eye parts 22, 23 and cylindrical bearings mounted on an axle 24, which in its turn by means of an adjustable bearing 25 is supported in an eye part 26, which as is indicated in FIG. 3, connected to the side wall 27 of one ship's half hull.

The piston rods 28, 29 are also by means of cylindrical bearings connected to an axle 30 which in its turn by means of an adjustable bearing 31 in a similar way is mounted in an eye part 32, which is connected to the side wall 33 of the other ship's half hull.

The axles 24 and 30 prevent an unequal outwards movement of the piston rods. Both cylinders are through said axles mechanically coupled into one unit notwithstanding the fact that each cylinder can be embodied as one separate and not excessively heavy unit. Eventual outward bending movements of both ship's half hulls have no influence on the mutual position of both cylinders, so that rigid conduits, such as steel pipes can be used for the hydraulic connection to the piston sides of the cylinders and the housing sides of the cylinders of each pair, with the result that only one locking head and safety valve is necessary for each pair of cylinders.

As shown in FIG. 3*a*, the housings of each pair of cylinders can be combined in one unit.

FIG. 5 illustrates the hydraulic diagram of a pair of cylinders as is illustrated in FIG. 3.

The conduits 35 and 36 meet at 37 and connect in this way the rod sides of the two cylinders. The same applies to the conduits 38 and 39 which meet at 40.

The locking head and safety valve comprises a safety valve 41 installed in the connection between the coupled rod sides and piston sides.

In the closed position of the ship both cylinders are locked by means of nonreturn valves 42 and 43. If a controlling pressure is applied to the valve 42 through the conduit 44 then said control conduit is opened and fluid can be supplied for moving the piston rods outwards because the controlling pressure has opened the valve 43. This is electrically indicated by means of the contact 45.

Connections 46 and 47 for respectively a low pressure and a high pressure pump are used for closing the ship, the connection 48 leading to a reservoir. The terminal 49 connects the nonreturn valve 42 with the return conduit.

As shown in FIG. 5*a*, the conduits 35 and 36 as well as safety valve 41 can be housed in a common housing 50.

I claim:

1. In a split hopper vessel comprising two half hulls which are pivotably connected to each other by means of a pivot shaft which extends at a high level parallel to the longitudinal axis of the ship, spaced apart cylinder pairs disposed below said pivot shaft and extending transverse to said pivot shaft and interconnecting said half hulls, said cylinders having housings pivotally connected to one half hull of the ship and piston rods pivotally connected to the other half hull of the ship, conduit means interconnecting the rod sides of said each pair of cylinders and the piston sides of each pair of cylinders, and a remotely controllable locking valve which also functions as a safety valve and is disposed in said conduit means; the improvement comprising a common axle connected by cylindrical bearings to the rods of each cylinder pair, a common axle connected by cylindrical bearings to the housings of each cylinder pair, a self-adjusting bearing surrounding each axle between the cylindrical bearings on the axle, each said self-adjusting bearing being mounted on a respective hull half, said conduit means being rigid, said conduits for said rod sides being connected to one side of said locking and safety valve, and said conduit means for said piston sides being connected to the other side of said locking and safety valve.

2. A split hopper vessel as claimed in claim 1, in which said housings of each pair of cylinders are combined in one unit.

3. A split hopper vessel as claimed in claim 1, in which said conduit means and safety valve are contained within a common housing.

* * * * *